US007243524B2

(12) United States Patent
Kinoshita

(10) Patent No.: US 7,243,524 B2
(45) Date of Patent: Jul. 17, 2007

(54) NEGATIVE-ANGLE PRESS-WORKING DIE

(75) Inventor: Tadatoshi Kinoshita, Kokubunji (JP)

(73) Assignee: Yourbusiness Co., Ltd., Tokyo (JP)

( * ) Notice: Subject to any disclaimer, the term of this patent is extended or adjusted under 35 U.S.C. 154(b) by 386 days.

(21) Appl. No.: 10/885,122

(22) Filed: Jul. 7, 2004

(65) Prior Publication Data

US 2005/0115301 A1 Jun. 2, 2005

(30) Foreign Application Priority Data

Nov. 27, 2003 (JP) ..... 2003-396640

(51) Int. Cl.
*B21D 11/00* (2006.01)
*B21D 5/02* (2006.01)
*B21J 9/18* (2006.01)

(52) U.S. Cl. ..... 72/381; 72/315; 72/452.9

(58) Field of Classification Search ..... 72/314, 72/315, 381, 384, 403, 452.9
See application file for complete search history.

(56) References Cited

U.S. PATENT DOCUMENTS 5,347,838 A * 9/1994 Matsuoka ..... 72/313
6,038,908 A 3/2000 Kinoshita
6,196,040 B1 * 3/2001 Matsuoka ..... 72/315
6,755,070 B2 * 6/2004 Jung ..... 72/452.9

FOREIGN PATENT DOCUMENTS

| | | | |
|---|---|---|---|
| EP | 0 427 886 | A1 | 5/1991 |
| EP | 0 857 525 | A1 | 8/1998 |
| EP | 1 044 739 | A2 | 10/2000 |
| EP | 1 044 739 | A3 | 10/2000 |
| JP | 03-005018 | A | 1/1991 |
| JP | 6-344030 | A | 12/1994 |
| JP | 2001-047135 | A | 2/2001 |
| JP | 2001-347319 | A | 12/2001 |

* cited by examiner

*Primary Examiner*—Derris H. Banks
*Assistant Examiner*—Teresa M. Bonk
(74) *Attorney, Agent, or Firm*—Rothwell, Figg, Ernst & Manbeck, P.C.

(57) ABSTRACT

Operations for uniting together a fixed support base 4 for fixedly supporting a workpiece W and a support die and for composing and decomposing a negative-angle press-forming die to take out a product processed by a negative-angle press-forming process are provided by an L-shaped die and a rotational support mechanism 21, serving as a pivot on which the L-shaped die is turned, inclined at an inclination determined according to the height range of a curved surface to be formed.

4 Claims, 5 Drawing Sheets

NEGATIVE-ANGLE PRESS-WORKING DIE

BACKGROUND OF THE INVENTION

The present invention relates to a negative-angle press-working die for forming an article having a complicated curved shape, such as a side panel of an automotive body, by pressing a plate. More specifically, the present invention relates to a negative-angle press-working die including a top die and a bottom die for forming an article having a negative-angle part which protrudes into the bottom die beyond the path of the top die when a plate is placed on the bottom die and is pressed by advancing the top die into the cavity of the bottom die.

A conventional press-forming method of forming an article having a negative-angle part forms the article by several working cycles. The press-forming method forms parts of the article excluding the negative-angle part by a first working cycle, and then forms the negative-angle part by a second working cycle.

For example, as mentioned in JP-A No. 2001-347319 or JP-A No. 2001-47135, a semifinished article not having any negative part is formed by holding a plate between a holding die held on a top die, a support base held on a bottom die, and an end member holding part of a swing die, a negative-angle part is formed by a slide cam member which moves vertically as the holding die of the top die moves vertically, the swing die is turned to complete the press work, and the plate is extracted.

A press-forming die proposed in JP-B No. 8-256 has a plurality of forming parts provided with a plurality of cylindrical, rotary cams each provided with an axial groove and having a negative-angle part formed at the edge of the axial groove and a length determined so that the negative-angle part is formed in the rotary cam.

Since the swing die is provided with a rotating support shaft extended parallel to the bottom surface of the body of a press-forming machine, parts of the parting line between a fixed support base and the support part of the swing die in different sections have different heights, respectively, when the swing die is used for forming an article having a curved shape curving in a big height range between parallel planes spaced a long distance apart, such as a front pillar of an automobile. Therefore, even if the fixed support base can be designed for one of the sections, the fixed support base cannot be formed for other sections. In addition, it is difficult to form a fixed support base for forming such an article. Thus, the press-forming process is divided into a plurality of steps or the plate is supported only by the workpiece support part of the rocking member without using the fixed support base.

Since the press-forming process can be performed only for a narrow range, press-forming dies are used, for example, to form an automotive panel including a front pillar, a roof, a middle part and a rear part. Thus, it is inevitably necessary to repeat the press-forming process many times.

A lift pin for tilting the swing die has a spherical tip that comes into point-contact with the bottom of the swing die, and slides along the bottom of the swing die to lift up the L-shaped rail end of the swing die. Therefore, energy is wasted by friction and serious scratching is possible.

In the press-forming die employing the cylindrical rotary cams having the axial groove and the negative-angle part formed at the edge of the axial groove, the rotary cams are rotational shafts. Therefore, the press-forming die has problems with machining accuracy due to the deconcentration of the axes and with sliding friction due to the sliding of the entire circumferences.

In the composite press-forming die formed by arranging the plurality of forming parts including the plurality of cylindrical rotary cams, rotational interference between the adjacent rotary cams is prevented by adjusting the rotating speed by a timing plate. Such adjustment is unable to cope with press work for forming an article having a curved surface curving in a big height range, needs a complicated mechanism, and has problems with reliability and cost.

SUMMARY OF THE INVENTION

The present invention has been made to solve the foregoing problems, and operations for uniting together a fixed support base for fixedly supporting a plate and a support die and for composing and decomposing a negative-angle die to take out a product processed by a negative-angle press-forming process are achieved by turning an L-shaped die, and a rotational support mechanism serving as a pivot on which the L-shaped die is turned is inclined at an inclination determined according to the height range of a curved surface to be formed.

Even when the fixed support base and the support die cannot be composed because the article to be formed has a curved surface curving in a big height range and is inclined to the pivotal axis of a main base beyond an upper tolerance limit, the rotational support shaft of the swing die is inclined according to the inclination of the curved shape to be formed. Therefore, the rotational support shaft is parallel to the height range of the curve shape to be formed, and the pivotal axis that does not obstruct the rocking motion of the die is determined.

In forming an automotive panel including a front pillar, a roof, a middle part and a rear part, the automotive panel is divided into design parts curving in an average height range as shown in FIG. 4, and the rotational axis is set parallel to the height range. Thus, a long panel can be formed by a single press-forming cycle using a negative-angle press-forming die formed by arranging segment dies in a line.

Moreover, in the segments of the negative-angle press-forming die, joining surfaces of the adjacent segments of the support die, and the top of the swing die having a negative-angle forming part are tapered, the joining surfaces of the tops of the adjacent swing dies overlap each other and can be smoothly separated such that the dies of the plurality of units are integrated.

A roller bearing that rolls in a direction in which the tip of the lifting pin slide relative to the bottom of the swing die is attached to the tip of the lifting pin that lifts up the tail end of the swing die after the completion of the negative-angle press-forming process to prevent wasting energy by friction and to eliminate causes of scratching.

DETAILED DESCRIPTION OF THE PREFERRED EMBODIMENT

Figure 1:
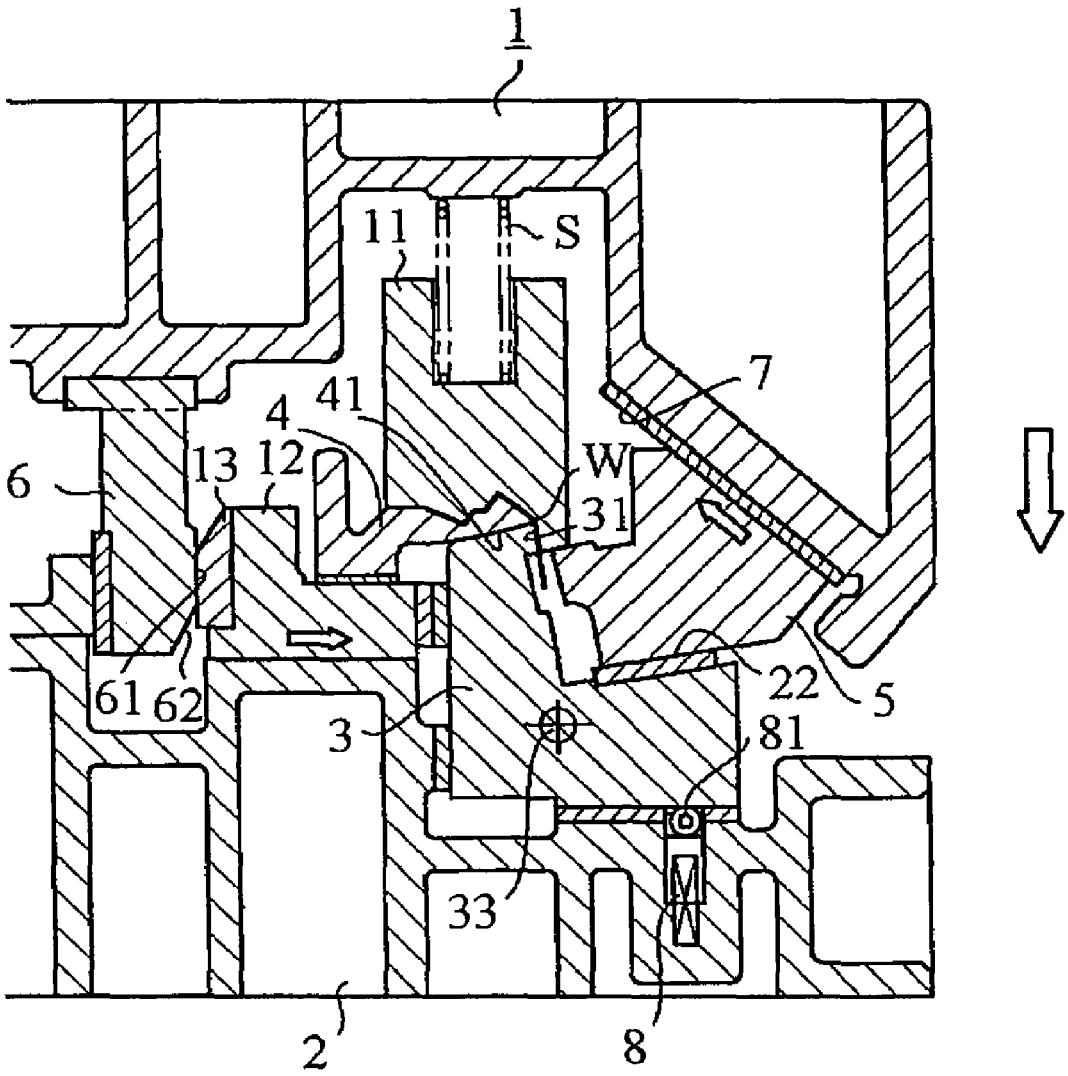
FIG. 1 is a longitudinal sectional view of a negative-angle press-forming die in a preferred embodiment according to the present invention in a state where a workpiece placed on a composite support formed by uniting a fixed support base and a support die is held between the composite support and a pressing die.

A preferred embodiment of the present invention will be described with reference to the accompanying drawings.

A press-forming die body has a top die 1 and a bottom die 2. The top die 1 is moved vertically relative to the bottom die 2 for a basic press-forming process.

A swing die 3 is substantially L-shaped. A support die 31 to be joined to the fixed support base 4 to support a workpiece W and a negative-angle female die part 32 are formed on the upper end of a standing part of the swing die 3. The swing die 3 is inclined at an inclination determined according to the height range of a curved shape to be formed. The swing die 3 is turned on a support shaft 33 by a rotational support mechanism 21 incorporated into the bottom die 2 so as to be joined to and to be separated from a joining part 41 of the fixed support base 4.

The support die 31 formed on the upper end of the swing die 3 and the support base 4 are united together by rocking the swing die 3. The swing die 3 can be smoothly united with and separated from the fixed support base 4 by forming a cut part 42 in the joining edge of the support base or the support die at the upper end of the swing die to form a clearance. Thus, the workpiece W can be easily taken out after the completion of the press-forming process.

A pressing die 11 is connected to the top die 1 by a shock-absorbing member S, such as a spring. The workpiece W is held between the pressing die 11, and the support die 31 united with the support base 4 held on the bottom die 2 when the top die 1 is lowered. When the top die 1 is lowered, a negative-angle male die part 51 formed on a slide cam 5 that moves vertically according to the vertical movement of the pressing die part of the top mold 1 is engaged with the negative-angle female die part 32 to press-form the workpiece W.

Figure 5:
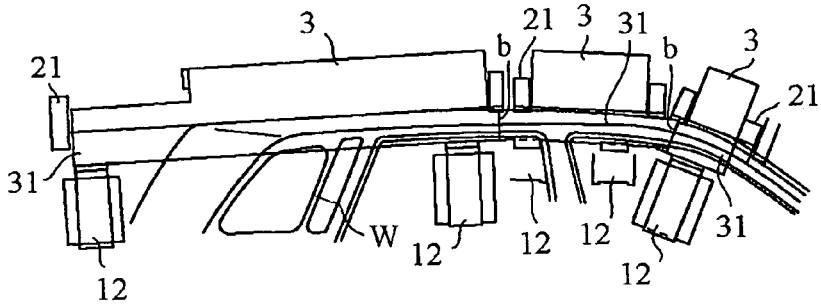
FIG. 5 is a plan view of assistance in explaining the relation between swing dies arranged contiguously in a line on a bottom die, and a curved shape in which a workpiece is to be shaped.

When the swing die 3, the fixed support base 4, the support die 31 and the slide cam 5, which perform the foregoing basic press-forming operations, are used for press-working a long workpiece W to form a long article, such as an automotive panel including, for example, a front pillar, a roof, a middle part and a rear part, swing dies 3, fixed support bases 4, support dies 31 and slide cams 5 respectively having curved shapes curving within an average height range, and corresponding to design parts of the long article may be used as shown in FIG. 5. The swing dies 3, the fixed support bases 4, the support dies 31 and the slide cams 5 are arranged in lines, respectively, on the top die 1 and the bottom die 2.

Figure 3:
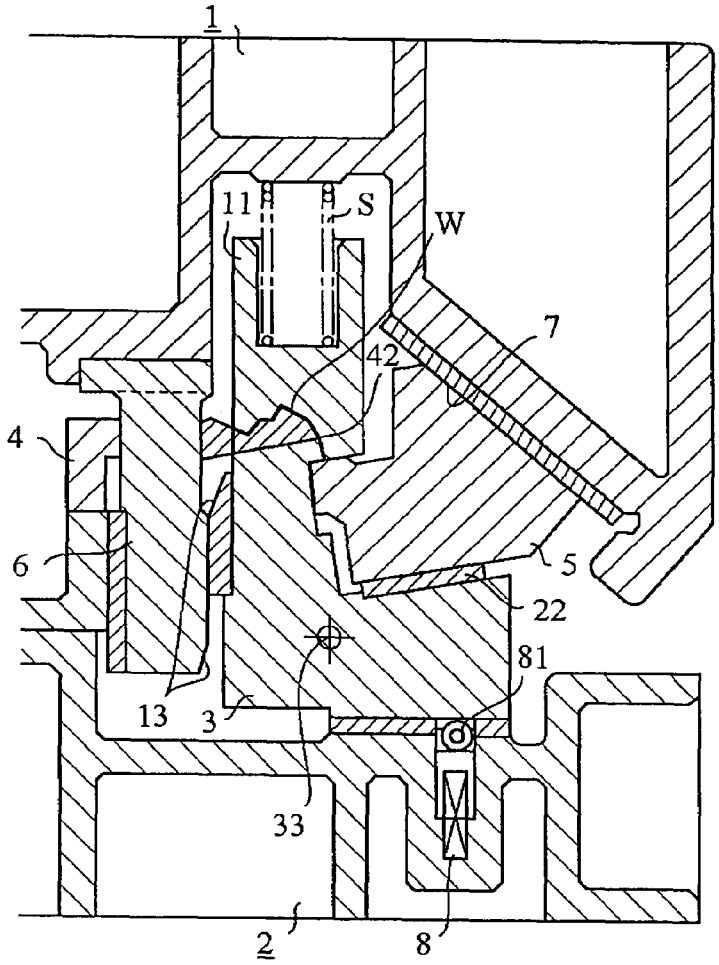
FIG. 3 is a longitudinal sectional view of a negative-angle press-forming die in another embodiment according to the present invention in a state where a slide cam member is pressed against a negative-angle female press-forming part to shape a workpiece by a negative-angle press-forming process.
Figure 4:
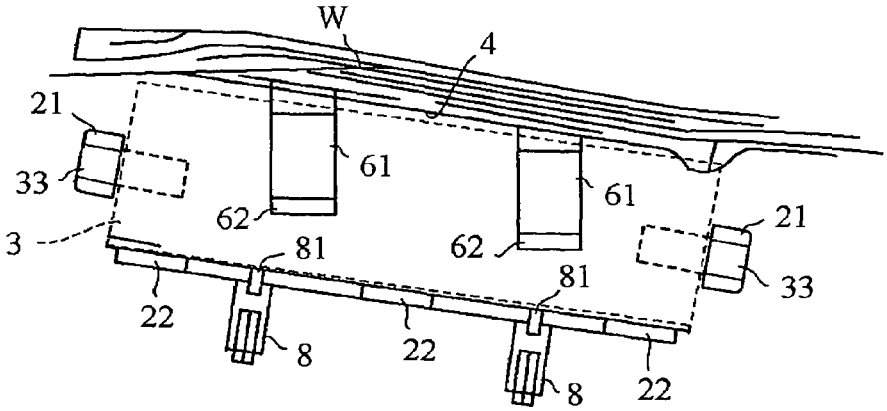
FIG. 4 is a front elevation of a rotational support mechanism for supporting a swing die, showing the relation between the rotational support mechanism inclined according to a height range in which a curved surface to be formed curves, and a drive cam, in which a swing die is omitted.

A drive cam 6 is held on the top die 1 for each die so as to move vertically together with the top die 1. The drive cam 6 drives a driven cam member 12 to turn the swing die 3 when the top die 1 is lowered. A slide cam 61 is formed by tapering a lower part 62 of the drive cam 6 toward the tower edge thereof. A taper cam 13 is attached to the back surface of the driven cam member 12. The slide cam 61 comes into sliding engagement with the taper cam 13 to turn the swing die 3 when the top die is lowered. The slide cams 61 for the segments of the swing die 3 are formed in different heights and different lengths such that the adjacent segments of the swing die 3 are turned at time intervals, respectively. The driven cam member 12 may be omitted and the taper cam 13 may be attached to the back surface of the swing die 3 as shown in FIG. 3.

Figure 8:
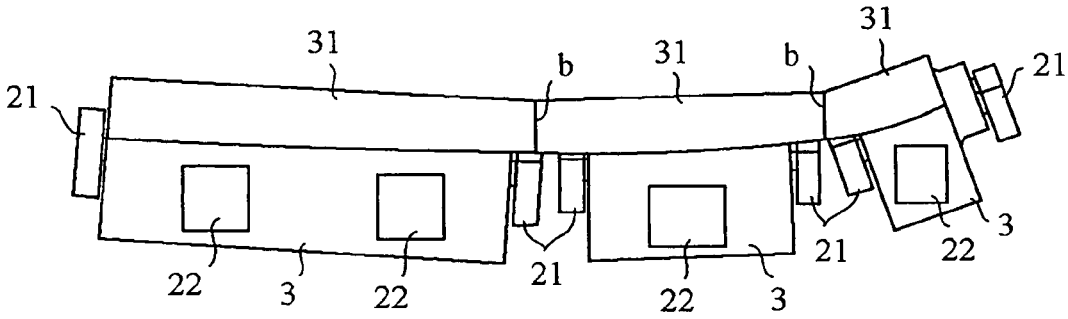
FIG. 8 is a plan view of a swing die swinging mechanism in a state where swing dies different from those shown in FIGS. 5 and 6, having taper joining surfaces and arranged in a line on a bottom die.
Figure 9:
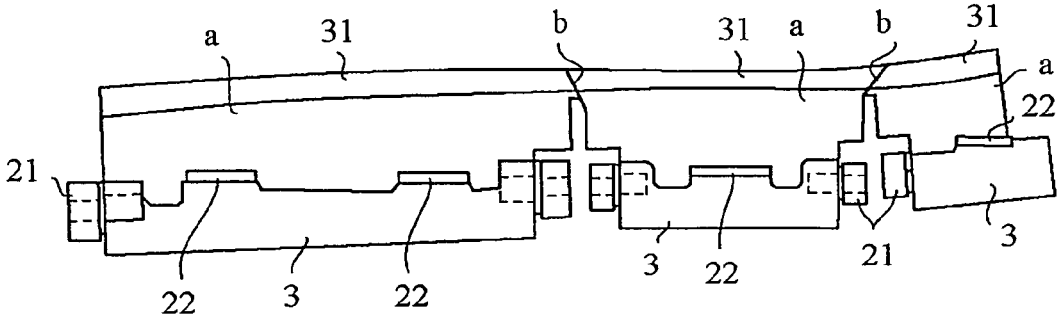
FIG. 9 is a front elevation of the swing die swinging mechanism shown in FIG. 8 in a state where adjacent swing dies are joined together.

In a swing die unit formed by arranging the swing dies 3 corresponding to parts of the long workpiece W, the joining surfaces b of the top parts a of the swing dies forming the support die and the negative-angle female press-forming parts are tapered as shown in FIGS. 8 and 9. The joining surfaces b of the adjacent top parts a of the swing dies can be smoothly joined together to form a single die and can be smoothly separated from each other.

A basic press-forming operation will be described. A workpiece W press-formed in a predetermined shape is placed closely on the support base 4 having the same shape as the workpiece W. At this stage, the tail end part of the swing die 3 is lifted up by a lifting pin 8 or a pneumatic cylinder actuator, and hence the support die 31 is not united with the support base 4.

Figure 2:
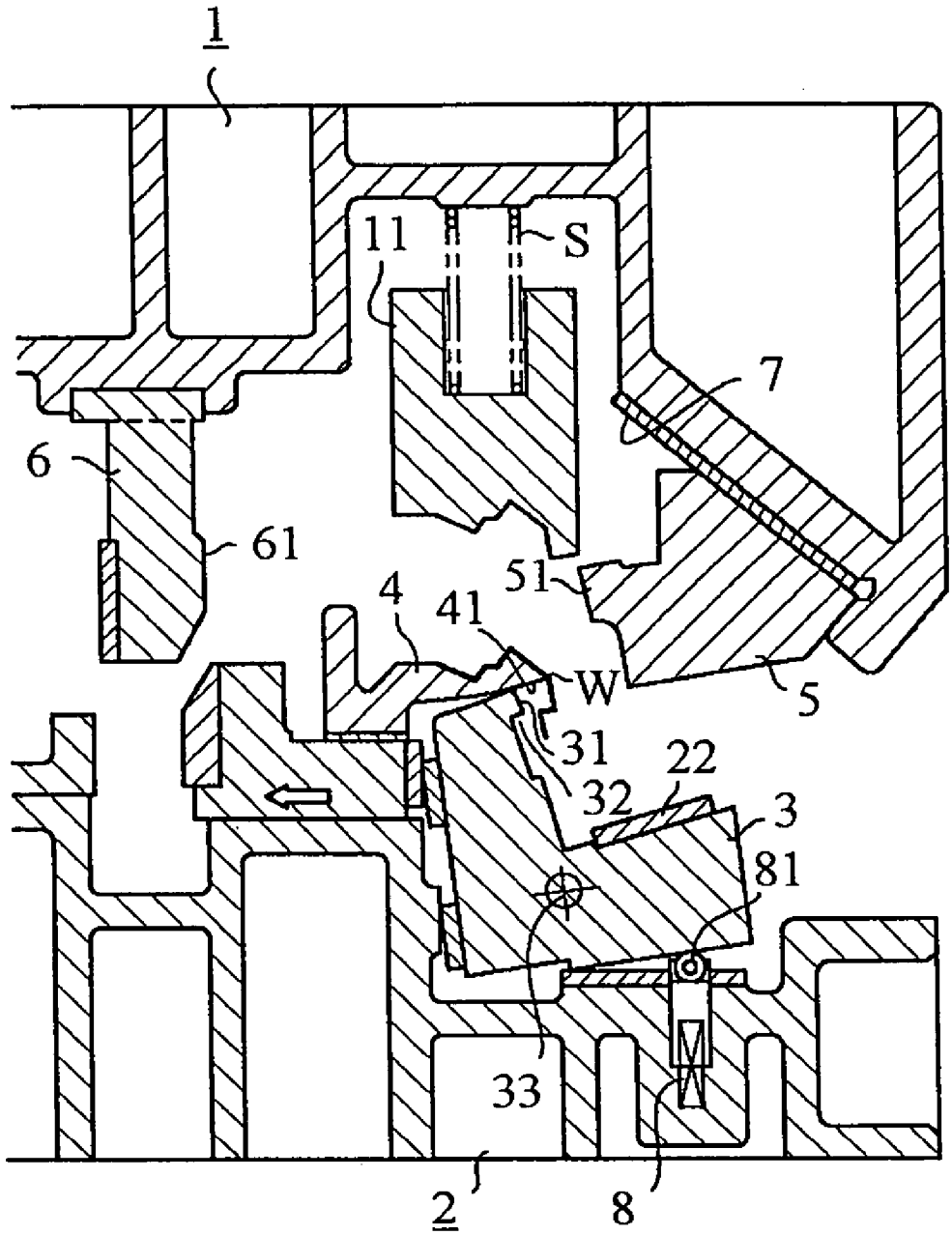
FIG. 2 is a longitudinal sectional view of the negative-angle press-forming die shown in FIG. 1 in a state where a press-forming process has been completed, and a swing die is turned to remove the workpiece from the negative-angle press-forming die.

After the top die 1 has started moving down, the drive cam 6 engages with the back surface of the drive cam member 12 or the back surface of the swing die 3 to turn the swing die 3 and to turn the swing die 3 clockwise, as viewed in FIG. 2, against the lifting force of the lifting pin 8 to form a composite support by uniting together the support die 31 and the support base 4. As the swing die 3 is thus turned, a roller bearing 81 supported on the tip of the lifting pin 8 rolls along the bottom surface of the swing die 3, so that the swing die 3 can be very smoothly turned.

Since the cut part 42 is formed at the joining edge of the support base 4, the support die 31 and the support base 4 can be very smoothly united together.

It goes without saying that the cut part may be formed in the support die 31. After the composite support has been completed, the pressing die 11 is lowered further to compress the workpiece W between the pressing die 11 and the composite support.

Subsequently, a slide base 7 supported on the top die 1 is lowered to bring the bottom surface of the slide cam 5 that slides along the lower surface of the slide base 7 into contact with a sliding guide plate 22 placed on the upper surface of the base part of the swing die 3. Consequently, the slide cam 5 is advanced and the negative-angle male die part 51 of the slide cam 5 is engaged with the negative-angle female die part 32 of the swing die 3 to press-form the workpiece W.

After the negative-angle press-forming of the workpiece W has been completed, the top die 1 starts moving up, the slide cam 5 retracts, the drive cam 6 pressing the back surface of the driven cam member 12 moves up, the slide cam 61 separates from the taper cam 13, and the swing die 3 is turned to its home position by the lifting pin 8. Then, the workpiece W can be removed from the press-forming die.

The respective heights and lengths of the taper cams 13 attached to the back surfaces of the driven cam members 12 that are pushed forward by the drive cam 6 moving vertically downward and the slide cams 61 formed respectively on lower end parts of the drive cam 6 are determined such that the swing dies 3 arranged in a line are turned so that the swing dies 3 of the adjacent units B and C may not interfere with each other.

The swing dies 3 operated by the slide cams 61 formed at positions nearer to the lower end of the drive cam 6 start turning earlier, and the swing dies 3 operated by the slide cams 61 formed at positions farther from the lower end of the drive cam 6 start turning later. The swing die 3 is turned slowly when the inclination of the slide cam 61 is small, and is turned rapidly when the inclination of the same is large.

Figure 6:
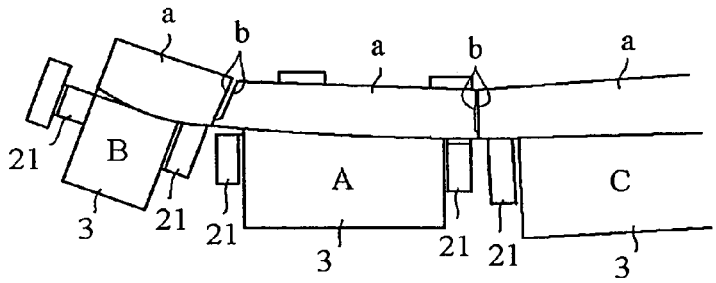
FIG. 6 is a schematic plan view of swing dies arranged in a line.
Figure 7:
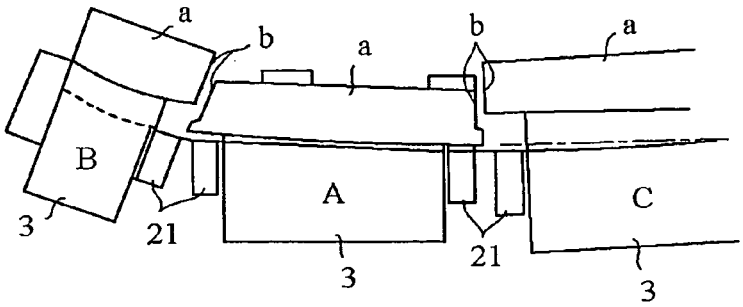
FIG. 7 is a plan view of assistance in explaining an operation for sequentially turning the swing dies shown in FIG. 6 at time intervals.

The slide cam 61 holds the swing die 3 at its working position for a long time when the slide cam 61 is long. The swing die 3 starts turning toward its home position at an early stage when the slide cam 61 is short. The swing cam 3 is turned through a large angle if the height of the slide cam 61 is high. Thus, the swing cams 3 arranged in a line are arranged contiguously as shown in FIG. 6 upon arrival of the top die 1 at its bottom dead center. When the top die 1 is at its top dead center or at a position between the top and the bottom dead center, the swing dies 3 are separated from each other and operates out of phase as shown in FIG. 7 and hence the swing dies 3 do not interfere with each other.

As apparent from the foregoing description, according to the present invention, the swing shaft can be surely and naturally set even in a state where the fixed support base and the support die cannot be united because the curved surface to be formed curves in a wide height range and inclines to the pivotal axis of the main base at an angle exceeding an upper tolerance limit. A long panel, which inevitably needed a plurality of press-forming processes, can be formed by a single press-forming process.

What is claimed is:

1. A negative angle press forming die, comprising:

a bottom die;

a rotational support mechanism incorporated into the bottom die;

a fixed support base;

a swing die, having a negative angle female press-forming part and a support die, supported by the rotational support mechanism and inclined at an inclination determined according to a height range of a curved shape to be formed;

a top die;

a pressing die, movably connected to the top die, to cooperate with the support die and the fixed support base to hold a workpiece therebetween; and a slide cam, moveable according to the vertical movement of the pressing die, having a negative angle male press forming die part to engage the negative angle female die part of the swing die to press form the workpiece, wherein the swing die is divided into swing die segments arranged in a line according to the height range of the curved surface to be formed, and cams for turning the swing die segments such that adjacent swing die segments are turned sequentially at time intervals, and wherein said cams include drive cams attached to the top die and taper cams attached to respective back surfaces of the swing die segments.

2. The negative angle press forming die according to claim 1, wherein a roller bearing is supported on a tip of a lifting pin for lifting up a tail end part of the swing die so as to roll along a bottom surface of the swing die when the lifting pin lifts up the tail end part of the swing die.

3. The negative angle press forming die according to claim 1, wherein the pressing die is movably connected to the top die by a shock-absorbing member.

4. The negative angle press forming die according to claim 3, wherein the shock-absorbing member is a spring.

* * * * *